US009321565B2

(12) United States Patent
Yamada et al.

(10) Patent No.: US 9,321,565 B2
(45) Date of Patent: Apr. 26, 2016

(54) CONTAINER CLOSURE

(75) Inventors: Motokatsu Yamada, Kanagawa (JP); Takahiro Akaogi, Kanagawa (JP)

(73) Assignee: NIPPON CLOSURES CO., LTD., Tokyo (JP)

( * ) Notice: Subject to any disclaimer, the term of this patent is extended or adjusted under 35 U.S.C. 154(b) by 0 days.

(21) Appl. No.: 14/352,840

(22) PCT Filed: Oct. 31, 2011

(86) PCT No.: PCT/JP2011/075104

§ 371 (c)(1), (2), (4) Date: Apr. 18, 2014

(87) PCT Pub. No.: WO2013/065111

PCT Pub. Date: May 10, 2013

(65) Prior Publication Data

US 2014/0252017 A1 Sep. 11, 2014

(51) Int. Cl.

*B65D 43/16* (2006.01)
*B65D 47/08* (2006.01)
*B65D 51/18* (2006.01)

(52) U.S. Cl.

CPC ..... *B65D 43/16* (2013.01); *B65D 47/0814* (2013.01); *B65D 47/0819* (2013.01); *B65D 51/18* (2013.01); *B65D 2251/0025* (2013.01); *B65D 2251/0087* (2013.01)

(58) Field of Classification Search

CPC .... B65D 47/04; B65D 47/046; B65D 47/061; B65D 47/065; B65D 47/066; B65D 47/08; B65D 47/0814; B65D 47/0833; B65D 47/0838; B65D 47/0885

USPC ..... 220/836

See application file for complete search history.

(56) References Cited

U.S. PATENT DOCUMENTS 4,638,916 A * 1/1987 Beck et al. ..... 215/235
4,895,282 A * 1/1990 Robinson ..... 222/482
4,949,883 A * 8/1990 Dubach ..... 222/556
5,257,708 A * 11/1993 Dubach ..... 220/827

(Continued)

FOREIGN PATENT DOCUMENTS

JP 2001-322659 11/2001
JP 4049800 2/2008

(Continued)

OTHER PUBLICATIONS

Search report from International Search Report in PCT/JP2011/075104, mail date is Jan. 24, 2012.

*Primary Examiner* — Anthony Stashick
*Assistant Examiner* — Robert Poon
(74) *Attorney, Agent, or Firm* — Greenblum & Bernstein, P.L.C.

(57) ABSTRACT

When the outer lid of a container closure is moved from a closed position for covering the upper surface wall of the body to an open position, the inner lid is moved from a closed position for closing a discharge port at the tip to an open position for opening the discharge port; and when the outer lid is moved from the open to the closed position, the inner lid is moved from the open to the closed position, the inner lid is prevented from becoming twisted. A second hinge connecting the inner lid to the discharge tube includes a central hinge piece connecting the inner lid and the discharge tube in a widthwise central part of the inner lid, and opposite side hinge pieces connecting the inner lid and the discharge tube on both outer sides in the width direction.

2 Claims, 4 Drawing Sheets

(56) References Cited

U.S. PATENT DOCUMENTS

| | | | | |
|---|---|---|---|---|
| 5,489,035 | A * | 2/1996 | Fuchs | 215/235 |
| 8,123,065 | B2 | 2/2012 | Mitsuhashi et al. | |
| 8,292,110 | B2 * | 10/2012 | Rutter | B65D 47/0838 215/201 |
| 2009/0107998 | A1 * | 4/2009 | Meissen | B65D 21/0233 220/254.3 |

FOREIGN PATENT DOCUMENTS

| | | |
|---|---|---|
| JP | 2008-074470 | 4/2008 |
| JP | 4402755 | 1/2010 |
| JP | 2010-126191 | 6/2010 |
| JP | 4471047 | 6/2010 |
| JP | 4799110 | 10/2011 |

* cited by examiner

CONTAINER CLOSURE

TECHNICAL FIELD

This invention relates to a container closure integrally formed from a synthetic resin, the container closure including a body and an outer lid pivotably connected to the body, wherein a discharge tube is disposed on the upper surface wall of the body; an inner lid is pivotably connected to the discharge tube; when the outer lid is pivotally moved from a closed position for covering the upper surface wall of the body to an open position, the inner lid is pivotally moved from a closed position for closing a discharge port present at the tip of the discharge tube to an open position for opening the discharge port; and when the outer lid is pivotally moved from the open position to the closed position, the inner lid is pivotally moved from the open position to the closed position.

BACKGROUND ART

Patent Documents 1 and 2 to be described below each disclose a container closure integrally formed from a synthetic resin and including a body and an outer lid, as a container closure which can be applied preferably to a container accommodating an edible oil or a liquid seasoning. The body has an upper surface wall, and a cylindrical side wall extending downwardly from the peripheral edge of the upper surface wall, while the outer lid has a top panel wall, and a cylindrical skirt wall extending downwardly from the peripheral edge of the top panel wall. The skirt wall of the outer lid and the side wall of the body are connected via a first hinge means, and the outer lid can be pivoted between a closed position for covering the upper surface wall of the body and an open position for exposing the upper surface wall of the body. A discharge tube extending out away from the first hinge means and having a discharge port formed at the tip thereof is disposed on the upper surface wall of the body. An inner lid is connected to the upper surface of the discharge tube via a second hinge means so as to be pivotable between a closed position for covering the discharge port and an open position for opening the discharge port. An interference means is disposed on the inner peripheral surface of the skirt wall of the outer lid. The interference means interferes with the inner lid to move the inner lid pivotally from the closed position to the open position while the outer lid is being pivoted from the closed position to the open position, whereafter the interference means is separated from the inner lid. Moreover, the interference means interferes with the inner lid to pivot the inner lid from the open position to the closed position while the outer lid is being pivoted from the open position to the closed position, whereafter the interference means is separated from the inner lid. A pressing means, which contacts the inner lid to force the inner lid into the closed position when the outer lid is pivoted from the open position to the closed position, is formed on the inner peripheral surface of the skirt wall and/or the inner surface of the top panel wall of the outer lid. The inner lid is a plate-shaped piece jutting out beyond opposite side surfaces of the discharge tube, and a seal ring engaging the discharge port is formed in a middle part of the inner surface of the inner lid. Stop projections are formed in opposite side parts of the inner surface of the inner lid, and receiving projections extending out upwards from the opposite side surfaces of the discharge tube are formed in the discharge tube. The stop projections ride resiliently over the receiving projections when the inner lid is moved pivotally from the closed position to the open position and when the inner lid is moved pivotally from the open position to the closed position.

PRIOR ART DOCUMENTS

Patent Documents

Patent Document 1: JP-A-2008-74470
Patent Document 2: JP-A-2010-126191

SUMMARY OF THE INVENTION

Problems to be Solved by the Invention

According to the present inventors' experience, however, the conventional container closures of the above-described form pose the following problems to be solved. The second hinge means is composed of the single hinge piece, which connects the inner lid and the discharge tube, between the stop projections and the receiving projections in the width direction of the plate-shaped piece constituting the inner lid, namely, in the central part in the width direction. This may cause an accident when a consumer contacts the inner lid via a cleaning cloth or the like, for example, in order to remove the content of the container or dust or the like deposited on the inner lid while the outer lid remains at the open position. That is, at the time of the contact, the single hinge piece may be twisted, resulting in an accidental twisted state in which the stop projection on one side in the width direction is located on an open side with respect to the receiving projection, whereas the stop projection on the other side in the width direction is located on a closed side with respect to the receiving projection. If the outer lid is pivoted toward the closed position, with such a twisted state being generated, there is a possibility that the outer lid will be brought to the closed position under excessive force, without proper pivoting of the inner lid from the open position to the closed position, accordingly, without proper closing of the discharge port.

The present invention has been accomplished in the light of the above-mentioned facts. Its principal technical challenge is to improve the container closure of the form described above such that the inner lid is prevented sufficiently reliably from becoming twisted as mentioned above.

Means for Solving the Problems

The present inventors conducted in-depth studies, and have found that the above principal technical challenge can be solved by constituting the second hinge means, which connects the inner lid pivotably to the discharge tube, by a central hinge piece connecting the inner lid and the discharge tube in a widthwise central part of the inner lid, and opposite side hinge pieces connecting the inner lid and the discharge tube on opposite sides further widthwise outward of the receiving projections.

That is, according to the present invention, there is provided, as a container closure solving the above-mentioned principal technical challenge, a container closure integrally formed from a synthetic resin and including a body, which has an upper surface wall and a cylindrical side wall extending downwardly from a peripheral edge of the upper surface wall, and an outer lid, which has a top panel wall and a cylindrical skirt wall extending downwardly from a peripheral edge of the top panel wall, wherein the skirt wall of the outer lid and the side wall of the body are connected via first hinge means; the outer lid is pivotable between a closed position for covering the upper surface wall of the body and an open position for exposing the upper surface wall of the body; a discharge tube extending out away from the first hinge means and having a discharge port formed at a tip thereof is disposed on the upper surface wall of the body; an inner lid is connected to an upper surface of the discharge tube via second hinge means so as to be pivotable between a closed position for covering the discharge port and an open position for opening the discharge port; interference means is disposed on an inner peripheral surface of the skirt wall of the outer lid, the interference means interferes with the inner lid to move the inner lid pivotally from the closed position to the open position while the outer lid is being pivoted from the closed position to the open position, whereafter the interference means rides over the inner lid and is separated from the inner lid, and the interference means also interferes with the inner lid to pivot the inner lid from the open position toward the closed position while the outer lid is being pivoted from the open position to the closed position, whereafter the interference means is separated from the inner lid; pressing means, which contacts the inner lid to force the inner lid into the closed position while the outer lid is being pivoted from the open position to the closed position, is formed on the inner peripheral surface of the skirt wall and/or an inner surface of the top panel wall of the outer lid; the inner lid is a plate-shaped piece jutting out beyond opposite side surfaces of the discharge tube; a seal ring engaging the discharge port is formed in a central part of an inner surface of the inner lid; stop projections are formed in opposite side parts of the inner surface of the inner lid; receiving projections extending out upwards are formed on opposite sides of the discharge tube; and the stop projections ride resiliently over the receiving projections when the inner lid is moved pivotally from the closed position to the open position and when the inner lid is moved pivotally from the open position to the closed position, characterized in that the second hinge means is composed of a central hinge piece connecting the inner lid and the discharge tube in a widthwise central part of the inner lid, and opposite side hinge pieces connecting the inner lid and the discharge tube on opposite sides further widthwise outward of the receiving projections.

It is preferred that extending-out pieces extending out upwardly and bilaterally from an upper surface of the discharge tube be annexed to the discharge tube, that the receiving projections be disposed on the extending-out pieces, and that an edge of each of the central hinge piece and an edge of each of the opposite side hinge pieces be connected to the extending-out pieces.

Effects of the Invention

With the container closure of the present invention, the second hinge means includes the opposite side hinge pieces connecting the inner lid and the discharge tube on the opposite sides further widthwise outward of the receiving projections, in addition to the central hinge piece connecting the inner lid and the discharge tube in the widthwise central part of the inner lid. Because of the presence of the opposite side hinge pieces, a twist of the central hinge piece is inhibited sufficiently effectively, so that the inner lid is prevented sufficiently reliably from becoming twisted.

MODE FOR CARRYING OUT THE INVENTION

The preferred embodiment of a container closure constituted according to the present invention will now be described in further detail with reference to the accompanying drawings.

Figure 1:
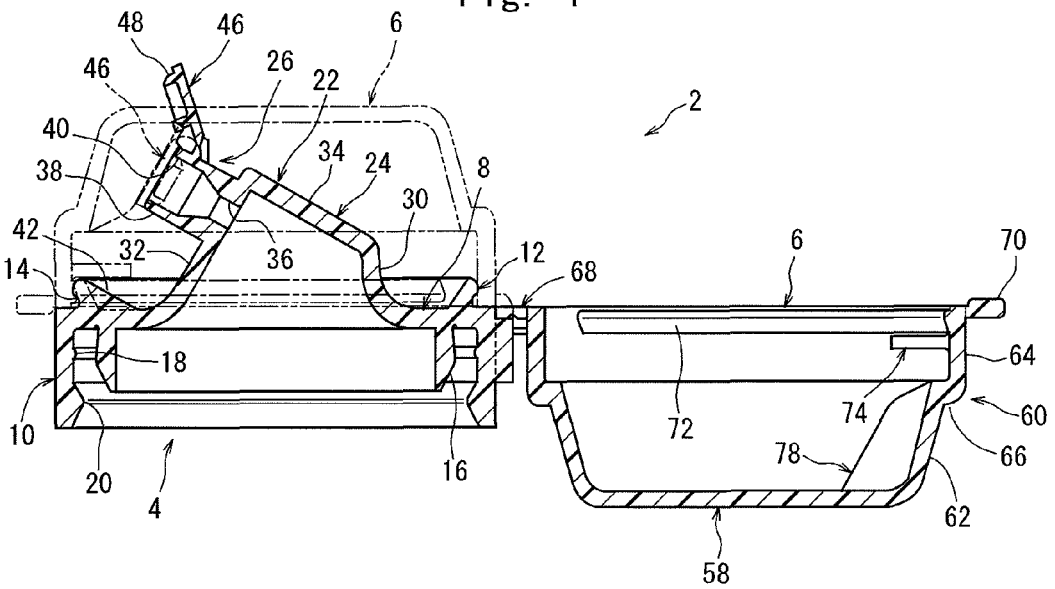
[FIG. 1] is a sectional view showing a preferred embodiment of a container closure constituted in accordance with the present invention, in a state in which an outer lid is located at an open position.
Figure 2:
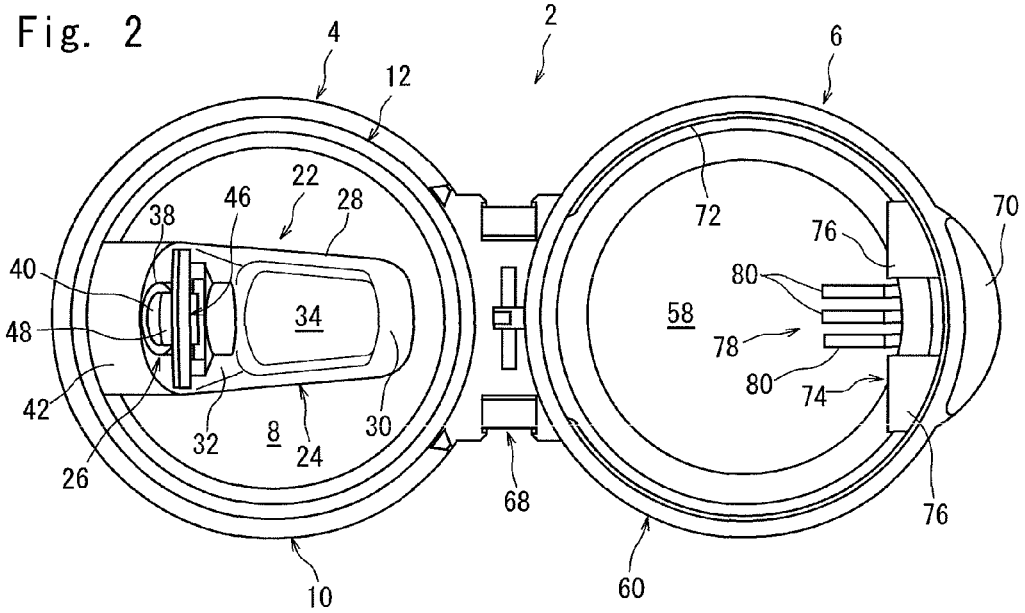
[FIG. 2] is a plan view showing the container closure shown in FIG. 1, in a state in which the outer lid is located at the open position.

With reference to FIGS. 1 and 2, a container closure indicated generally at 2, constituted in accordance with the present invention, can be integrally injection-molded from a suitable synthetic resin such as polyethylene or polypropylene. Such a container closure 2 includes a body 4 and an outer lid 6.

The body 4 has an upper surface wall 8, circular in a plan view, and a cylindrical side wall 10 extending downwardly from the peripheral edge of the upper surface wall 8. An annular ridge 12 protruding upward is formed in an outer peripheral edge part of the upper surface of the upper surface wall 8. An annular stop groove 14 is formed in a lower part of the outer peripheral surface of the annular ridge 12. The inner peripheral surface of the annular ridge 12 is inclined radially inwardly toward a lower side. A cylindrical sealing ridge 16 protruding downward is formed at the outer peripheral edge of the lower surface of the upper surface wall 8. An annular small ridge 18 is formed in an upper part of the inner peripheral surface of the side wall 10, and an annular stop ridge 20 is formed in a lower part of the inner peripheral surface of the side wall 10.

With further reference to FIGS. 1 and 2, a discharge tube indicated generally at 22 is formed in the upper surface wall 8 of the body 4. Such a discharge tube 22 is extended out away from a first hinge means to be described later, namely, leftward in FIG. 1. The discharge tube 22 in the illustrated embodiment has a base portion 24 and a leading end portion 26. The base portion 24 is defined by a pair of side wall portions 28 extending out upward substantially vertically, a rear wall portion 30 extending in a nearly arcuate shape, a front wall portion 32 extending upward in a radially inwardly inclined manner, and an upper wall portion 34 extending forwardly (i.e., leftward in FIG. 1) between the upper edge of the rear wall portion 30 and the upper edge of the front wall portion 32 in an upwardly inclined manner. A through-hole 36 which may be circular is formed in an upper part of the front wall portion 32 of the base portion 24. The leading end portion 26 of the discharge tube 22 is defined by a cylindrical protruding tubular portion 38 extending out forwardly from the front surface of the front wall portion 32 of the base portion 24 in an upwardly inclined manner. The base edge of the protruding tubular portion 38 surrounds the through-hole 36, and the central axis of the protruding tubular portion 38 is brought into coincidence with the central axis of the through-hole 36. A circular discharge port 40 is formed at the leading end of the protruding tubular portion 38. An arc-shaped bearer 42 is formed between the base portion 24 of the discharge tube 22 and the aforementioned annular ridge 12, and the upper surface of the arc-shaped bearer 42 extends forward in an upwardly inclined manner from the lower edge of the front wall portion 32 of the base portion 24 up to the upper edge of the inner peripheral surface of the annular ridge 12.

Figure 3:
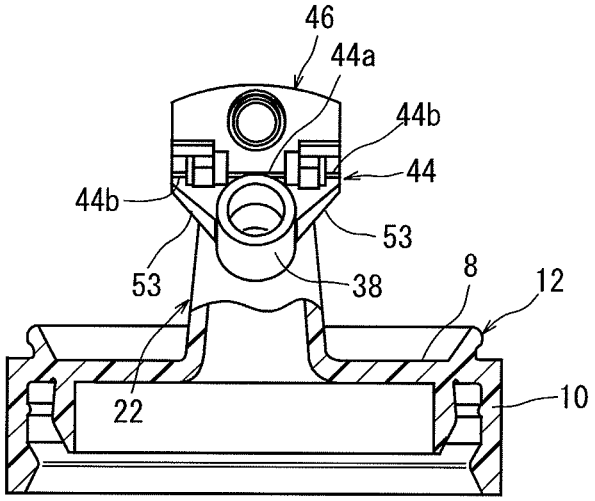
[FIG. 3] is a partially sectional view showing a body of the container closure shown in FIG. 1.
Figure 4:
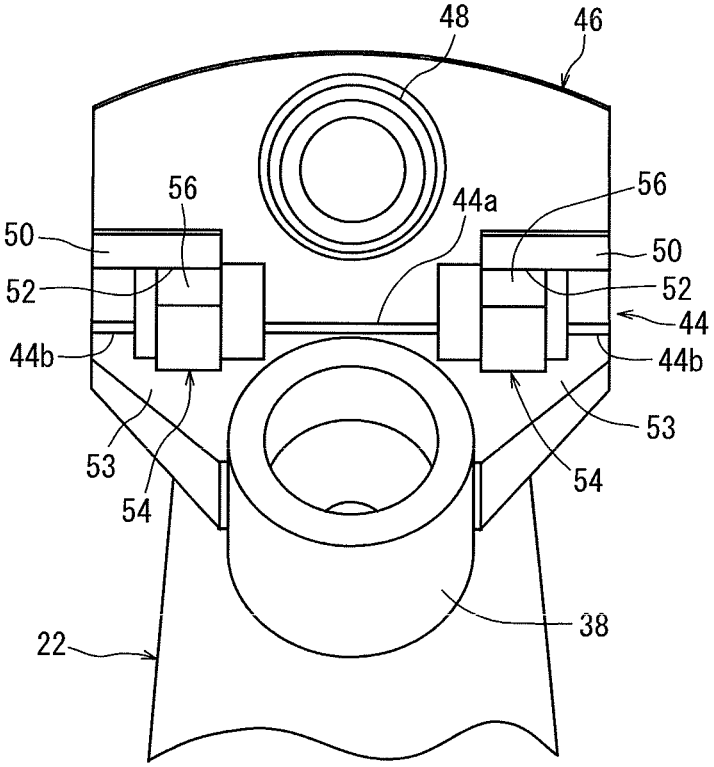
[FIG. 4] is a partly enlarged view showing the interrelationship between an inner lid and a discharge tube in the body of the container closure shown in FIG. 1.

With reference to FIGS. 3 and 4 along with FIGS. 1 and 2, an inner lid 46 is connected via a hinge means 44 (the hinge means 44 constituting a second hinge means will be described later in further detail) to the upper surface of the protruding tubular portion 38 of the discharge tube 22. Such an inner lid 46 is free to move between an open position indicated by solid lines in FIGS. 1 to 4 and a closed position indicated by dashed double-dotted lines in FIG. 1 (the movement of the inner lid 46 will be further mentioned later). The inner lid 46 is composed of a laterally elongated plate-shaped piece jutting out beyond the protruding tubular portion 38 of the discharge tube 22, and has an arcuate upper edge. A circular seal ring 48 is formed in a middle part in the width direction of the inner surface of the inner lid 46. The external diameter of the seal ring 48 is substantially the same as the internal diameter of the leading end part of the protruding tubular portion 38 of the discharge tube 22 and, when the inner lid 46 is brought to the closed position, the seal ring 48 is fitted into the protruding tubular portion 38 to seal the leading end of the protruding tubular portion 38. Stop projections 50 are formed in opposite side parts of the base end (i.e., lower end in FIGS. 3 and 4) of the inner surface of the inner lid 46. Such stop projections 50 have flat stop surfaces 52 located at the lowermost position, with the inner lid 46 being located at the open position.

Figure 5:
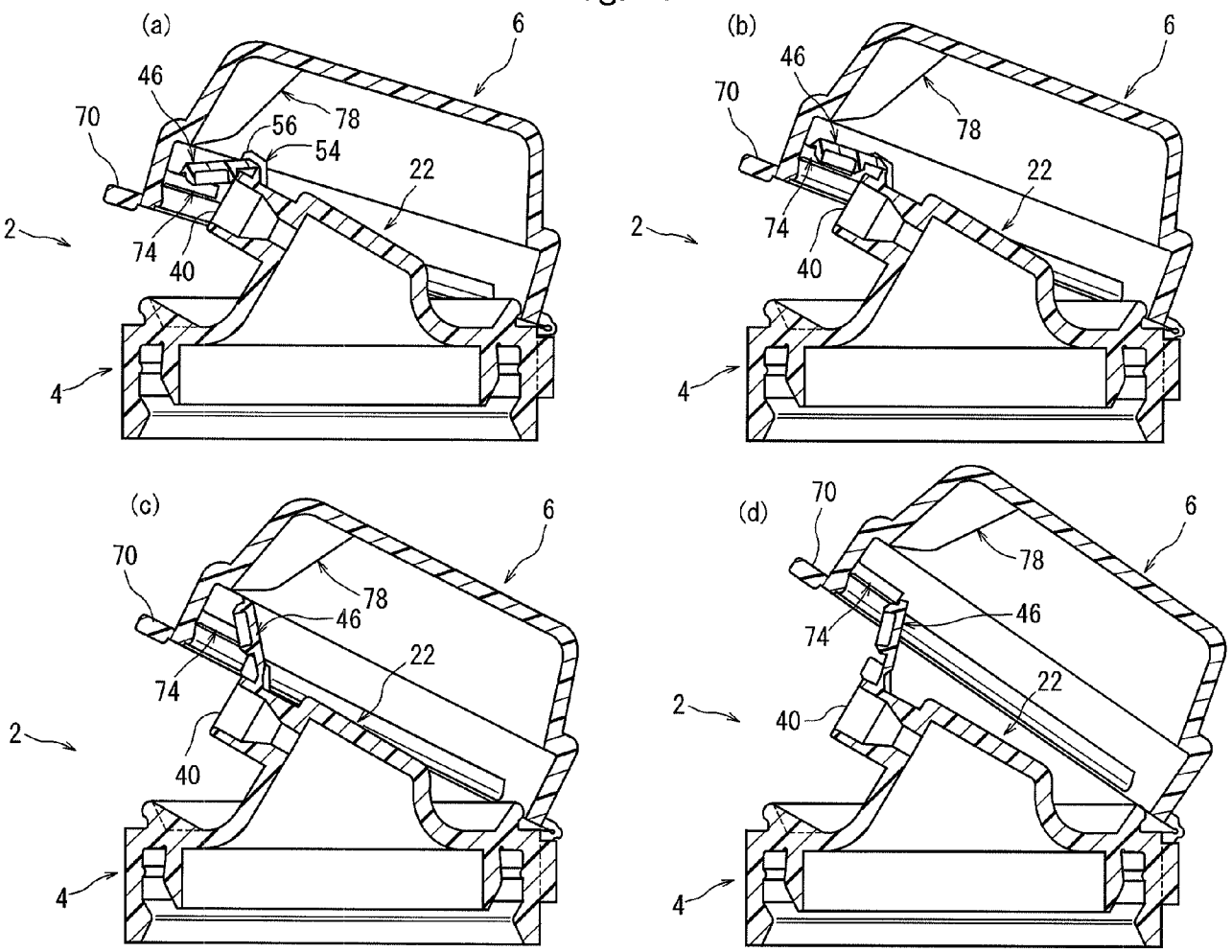
[FIGS. 5(*a*) to 5(*d*)] are sectional views showing behaviors of the container closure shown in FIG. 1 when the outer lid is moved, for opening, from a closed position to the open position.

As will be clearly understood by referring to FIGS. 4 and 5(*a*) along with FIG. 2, extending-out pieces 53 extending out upwardly and bilaterally are formed on the upper surface of the discharge tube 22, and receiving projections 54 as a pair are formed, with spacing in the width direction (right and left direction in FIG. 4), in the extending-out pieces 53. The receiving projections 54 have receiving surfaces 56 which are preferably inclined forwardly downwardly (for the details of the receiving projection 54 and the stop projection 50, reference is requested to the aforementioned Patent Document 2). The hinge means 44 is disposed between the base end of the inner lid 46 and the leading edge (upper edge in FIGS. 3 and 4) of each extending-out piece 53. It is important for the hinge means 44 to include a central hinge piece 44*a* disposed in a widthwise central part (accordingly, between the paired receiving projections 54), and opposite side hinge pieces 44*b* disposed widthwise outwardly of the paired receiving projections 54. The central hinge piece 44*a* and the opposite side hinge pieces 44*b* are arranged horizontally in a straight line to constitute a thin-walled line, and the inner lid 46 is pivotally moved about the thin-walled line as a pivot center line.

With further reference to FIGS. 1 and 2, the outer lid 6 has a circular top panel wall 58 and a cylindrical skirt wall 60 extending downwardly from the peripheral edge of the top panel wall 58. In the illustrated embodiment, the skirt wall 60 has a truncated cone-shaped cylindrical upper part 62 and a cylindrical lower part 64, and an annular shoulder surface 66 directed upwards is formed in an intermediate part of the outer peripheral surface of the skirt wall 60 (the terms "upper" and "lower" and relevant terms for the outer lid 6 mean upper and lower positions in the state of the outer lid 6 located at the closed position indicated by the dashed double-dotted lines in FIG. 1). A hinge means designated generally by the numeral 68 is disposed between the lower end of the outer peripheral surface of the skirt wall 60 of the outer lid 6 and the side wall 10 of the body 4 (the hinge means 68 constitutes a first hinge means). The outer lid 6 is connected to the body 4 via the hinge means 68 mentioned above, and the outer lid 6 is pivotally moved between the open position indicated by the solid lines in FIGS. 1 and 2 and the closed position indicated by the dashed double-dotted lines in FIG. 1 (the pivotal movement of the outer lid 6 will be further mentioned later). If the side wall 10 of the body 4 is configured to have an annular or arcuate groove formed from the upper surface thereof to a predetermined depth and is of a double-walled structure at least in an upper part thereof at a site where the hinge means 68 is disposed, the hinge means 68 can be disposed between an upper edge part of the outer wall region of the double-walled structure and the lower end of the outer peripheral surface of the skirt wall 60 of the outer lid 6. The hinge means 68 may be of a well-known form per se, and thus an explanation for the configuration of the hinge means 68 is omitted. On the side diametrically opposite from the hinge means 68, an arc-shaped protruding piece 70, which a finger can be hooked on when the outer lid 6 is to be pivotally moved, is formed at the lower end of the outer peripheral surface of the skirt wall 60.

A stop ridge 72 extending arcuately, except in the region where the hinge means 68 exists, is formed in a lower end part of the inner peripheral surface of the lower part 64 of the skirt wall 60. Further, an interference means 74 is also disposed on the inner peripheral surface of the skirt wall 60. In the illustrated embodiment, the interference means 74 is composed of a pair of plate-shaped pieces 76, spaced from each other in the circumferential direction and protruding horizontally from the inner peripheral surface of the lower part 64 of the skirt wall 60, on the side diametrically opposite from the hinge means 68. Such plate-shaped pieces 76 are located slightly above the stop ridge 72. A pressing means 78 is also disposed on the inner peripheral surface of the skirt wall 60. In the illustrated embodiment, the pressing means 78 is composed of three pressing pieces 80 protruding, with spacing therebetween in the circumferential direction, from the inner peripheral surface of the upper part 62 of the skirt wall 60 and from a peripheral edge part of the inner surface of the top panel wall 58 on the side diametrically opposite from the hinge means 68. Each of the pressing pieces 80 is extended substantially vertically, and the protruding edge of each pressing piece is inclined downwardly outwardly. If desired, the pressing means 78 can be composed of a single wide pressing piece extending uninterruptedly in the width direction.

The above-mentioned container closure is applied preferably to a mouth-and-neck portion of a container (not shown) accommodating an edible oil or a liquid seasoning. When the container closure 2 is to be mounted on the mouth-and-neck portion of the container, an upper end part of the mouth-and-neck portion of the container is inserted into an annular space between the side wall 10 and the sealing ridge 16 of the body 4, with the result that the mouth-and-neck portion is sealed with the sealing ridge 16 advancing into the mouth-and-neck portion.

When the outer lid 6 is located at the closed position indicated by the dashed double-dotted lines in FIG. 1, the stop ridge 72 formed in the lower end part of the inner peripheral surface of the skirt wall 60 of the outer lid 6 is engagingly stopped by the stop groove 14 formed in the lower part of the outer peripheral surface of the annular ridge 12 of the body 4, whereby the outer lid 6 is maintained at the closed position. When the outer lid 6 is located at the closed position, moreover, the pressing means 78 contacts the outer surface of the inner lid 46 (namely, the surface on the side opposite to the surface on which the seal ring 48 is formed) to force the inner lid 46 into the closed position, thus sealing the discharge port 40 of the discharge tube 22 fully reliably.

When the contents accommodated in the container having the container closure 2 mounted thereon are to be consumed, a finger is hooked on the protruding piece 70 formed on the outer peripheral surface of the skirt wall 60 of the outer lid 6 to pivotally move the outer lid 6 from the closed position indicated by the dashed double-dotted lines in FIG. 1 toward the open position indicated by the solid lines in FIGS. 1 and 2. With further reference to FIGS. 5(*a*) to 5(*d*) along with FIG. 1, when the outer lid 6 is moved, for opening, to the position illustrated in FIG. 5(*a*), the pressing means 78 is sufficiently separated from the outer surface of the inner lid 46, and the interference means 74 formed on the inner peripheral surface of the skirt wall 60 of the outer lid 6 contacts the opposite side parts of the inner surface of the inner lid 46 to begin interfering with the inner lid 46. Then, when the outer lid 6 is moved, for opening, from the position illustrated in FIG. 5(*a*) to the position illustrated in FIG. 5(*c*) past FIG. 5(*b*), the stop projections 50 disposed on the inner lid 46 to be opened in association with the opening movement of the outer lid 6 resiliently ride over the receiving projections 54 disposed in the discharge tube 22 (reference is also requested to FIG. 4). When the outer lid 6 is further moved, for opening, to the position illustrated in FIG. 5(*d*), the inner lid 46 is also further moved for opening attendantly. When the outer lid 6 is further moved, for opening, beyond the position illustrated in FIG. 5(*d*), the interference means 74 of the outer lid 6 is separated from the inner lid 46. Upon separation of the interference means 74 of the outer lid 6 from the inner lid 46, the inner lid 46 tends to be resiliently moved for closing toward the closed position. However, the stop surfaces 52 of the stop projections 50 of the inner lid 46 contact the receiving surfaces 56 of the receiving projections 54 disposed in the discharge tube 22. As a result, the closing movement of the inner lid 46 is inhibited, and the inner lid 46 is maintained at the open position.

As noted above, when the outer lid 6 is moved for opening, the inner lid 46 is moved for opening in accordance with this movement. Thus, the consumer can discharge the contents of the container through the discharge tube 22 without the need to hook his or her finger on the inner lid 46 itself and move it for opening. If the content of the container or dust or the like adheres to the inner surface of the inner lid 46, on the other hand, the consumer may wipe the inner lid with a cleaning cloth or paper. On this occasion, an offset load tends to be imposed on the inner lid 46. In the container closure 2 constituted in accordance with the present invention, however, the hinge means 44 which connects the inner lid 46 to the discharge tube 22 includes the central hinge piece 44*a* disposed in the widthwise central part, and the opposite side hinge pieces 44*b* disposed widthwise outwardly of the paired receiving projections 54. Even if offset load is imposed on the inner lid 46, therefore, twisting of the hinge means 44 of the inner lid 46 is prevented sufficiently reliably, so that the inner lid 46 is not brought into a twisted state.

Figure 6:
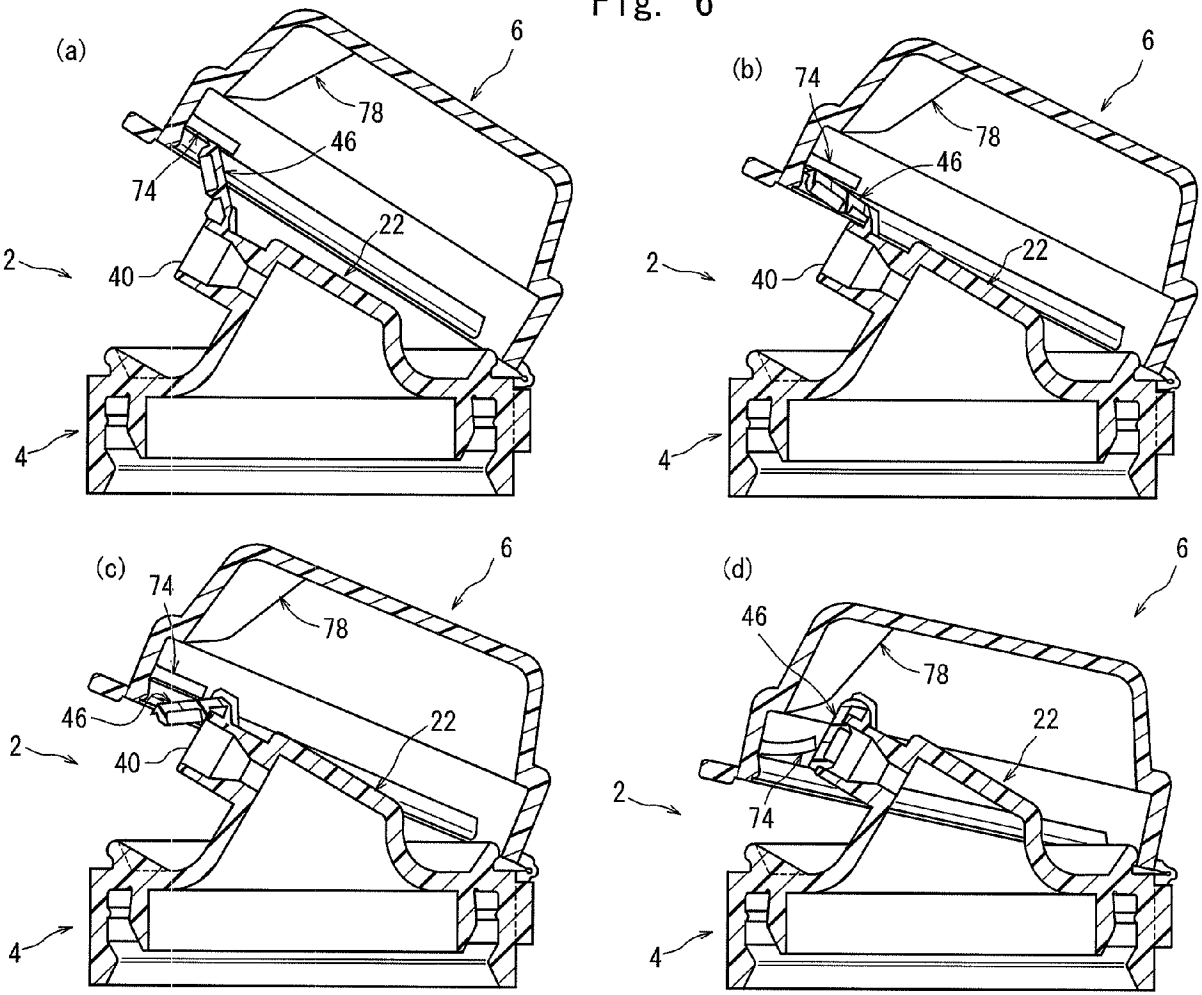
[FIGS. 6(*a*) to 6(*d*)] are sectional views showing behaviors of the container closure shown in FIG. 1 when the outer lid is moved, for closing, from the open position to the closed position.

After the consumption of the contents is completed, the outer lid 6 is moved pivotally from the open position illustrated in FIGS. 1 and 2 to the closed position indicated by the dashed double-dotted lines in FIG. 1. With further reference to FIGS. 6(*a*) to 6(*d*) along with FIG. 1, when the outer lid 6 is moved, for closing, to the position illustrated in FIG. 6(*a*), the interference means 74 formed on the skirt wall 60 of the outer lid 6 contacts the outer surface of the inner lid 46, which is located at the open position, to begin interfering with the inner lid 46. Then, when the outer lid 6 is moved, for closing, from the position illustrated in FIG. 6(*a*) to the position illustrated in FIG. 6(*b*), the inner lid 46 is also moved for closing in accordance with the closing motion of the outer lid 6, and the stop projections 50 disposed on the inner lid 46 resiliently ride over the receiving projections 54 disposed in the discharge tube 22. When the outer lid 6 is moved, for closing, from the position illustrated in FIG. 6(*b*) to the position illustrated in FIG. 6(*d*) via FIG. 6(*c*), the inner lid 46 is also moved for closing attendantly. As a result, the inner lid 46 is brought to the closed position at which it seals the discharge port 40 of the discharge tube 22. When the outer lid 6 is further moved for closing beyond the position illustrated in FIG. 6(*d*), the interference means 74 of the outer lid 6 is separated from the inner lid 46. After separation of the interference means 74 from the inner lid 46, the inner lid 46 tends to be pivotally moved in the opening direction owing to its resilient action. However, while the outer lid 6 is being moved for closing to the closed position indicated by the dashed double-dotted lines in FIG. 1, the pressing means 78 disposed on the outer lid 6 contacts the outer surface of the inner lid 46 to force the inner lid 46 into the closed position. Moreover, the stop ridge 72 formed in the outer lid 6 is engagingly stopped by the stop groove 14 formed in the annular ridge 12 of the body 4, whereby the outer lid 6 is maintained at the closed position.

Explanations of Letters or Numerals

2: Container closure
4: Body
6: Outer lid
8: Upper surface wall of body
10: Side wall of body
22: Discharge tube
44: Hinge means (second hinge means)
44*a*: Central hinge piece
44*b*: Opposite side hinge piece
46: Inner lid
48: Seal ring
50: Stop projection
53: Extending-out piece
54: Receiving projection
58: Top panel wall of outer lid
60: Skirt wall of outer lid
68: Hinge means (first hinge means)
74: Interference means
78: Pressing means

The invention claimed is:

1. An integrally formed synthetic resin container closure comprising:

a body including an upper surface wall and a cylindrical side wall extending downwardly from a peripheral edge of the upper surface wall;

an outer lid including, when in a closed position, a top panel wall and a cylindrical skirt wall extending downwardly from a peripheral edge of the top panel wall;

a first hinge connecting the cylindrical skirt wall of the outer lid and the side cylindrical wall of the body, whereby the outer lid can pivot between the closed position covering the upper surface wall of the body and an open position exposing the upper surface wall of the body;

a discharge tube disposed on the upper surface wall and extending out and away from the first hinge;

a discharge port coupled to a portion of the discharge tube;

an inner lid connecting to an upper surface of the discharge tube via a second hinge, whereby the inner lid can pivot between a closed position covering the discharge port and an open position opening the discharge port;

an interference mechanism disposed on an inner peripheral surface of the skirt wall of the outer lid and being configured to each of:

contact the inner lid, pivot the inner lid from the closed position to the open position while the outer lid is being pivoted from the closed position to the open position, and separate from contact with the inner lid;

contact the inner lid to pivot the inner lid from the open position toward the closed position while the outer lid is being pivoted from the open position to the closed position, and separate from contact with the inner lid;

a pressing mechanism configured to contact the inner lid to force the inner lid into the closed position while the outer lid is being pivoted from the open position to the closed position;

the pressing mechanism being arranged on at least one of:

the inner peripheral surface of the cylindrical skirt wall; and/or an inner surface of the top panel wall of the outer lid;

the inner lid being a plate-shaped member having ends jutting out beyond opposite side surfaces of the discharge tube;

a seal ring being configured to engage the discharge port is arranged on a central part of an inner surface of the inner lid;

stop projections arranged in opposite side portions of the inner surface of the inner lid;

receiving projections extending out and upwards from opposite sides of the discharge tube;

the stop projections being configured to ride resiliently over the receiving projections when the inner lid is pivoted from the closed position to the open position and when the inner lid is pivoted from the open position to the closed position;

the second hinge comprising:

a central hinge located in a widthwise central part of the inner lid; and first and second opposite side hinges;

the first opposite side hinge being located further widthwise outward of one of the receiving projections and the second opposite side hinge is located further widthwise outward of another of the receiving projections;

the central hinge and the first and second opposite side hinges being thin-wall sections arranged horizontally in a straight line; and extending-out pieces extending out and upwardly and bilaterally from an upper surface of the discharge tube, wherein the central hinge and the first and second opposite side hinges are connected to portions of the extending-out pieces.

2. The container closure according to claim 1, wherein the first and second opposite side hinges are configured to prevent twisting of the inner lid during pivoting movement of the inner lid.

* * * * *